US005217129A

United States Patent [19]

Portengen

[11] Patent Number: 5,217,129

[45] Date of Patent: Jun. 8, 1993

[54] VIAL AND CAP ASSEMBLY HAVING MEANS FOR SEALING A TUBE PROJECTING BEYOND THE VIAL RESERVOIR

[75] Inventor: Arnoldus Portengen, Weesp, Netherlands

[73] Assignee: Duphar International Research B.V., Weesp, Netherlands

[21] Appl. No.: 788,511

[22] Filed: Nov. 6, 1991

[30] Foreign Application Priority Data

Nov. 9, 1990 [NL] Netherlands ..... 9002447

[51] Int. Cl.[5] ..... B65D 21/00

[52] U.S. Cl. ..... 215/10; 215/DIG. 3; 215/307

[58] Field of Search ..... 215/10, 11.1, DIG. 3, 215/248, 307; 604/407, 411, 414, 415

[56] References Cited

U.S. PATENT DOCUMENTS

| | | | |
|---|---|---|---|
| 646,018 | 3/1900 | Cook, Jr. | 215/307 X |
| 1,137,388 | 4/1915 | Earp-Thomas | 215/DIG. 3 X |
| 1,731,816 | 10/1929 | Garhart | 215/307 X |
| 2,085,392 | 6/1937 | Reichel | 215/DIG. 3 X |
| 2,190,054 | 2/1940 | Cutter et al. | 215/DIG. 3 X |
| 2,231,418 | 2/1941 | Trotter | 215/DIG. 3 X |
| 2,500,199 | 3/1950 | Nesset | 604/407 |
| 3,253,728 | 5/1966 | DePutron | 215/307 X |
| 3,688,812 | 9/1972 | Fredericks . | |
| 4,266,681 | 5/1981 | Fredericks . | |
| 4,997,430 | 3/1991 | Van der Heiden et al. | 604/414 |

FOREIGN PATENT DOCUMENTS

| | | | |
|---|---|---|---|
| 0167303 | 12/1958 | Australia | 604/407 |
| 818241 | 10/1951 | Fed. Rep. of Germany . | |
| 840751 | 6/1952 | Fed. Rep. of Germany . | |
| 354448 | 10/1905 | France . | |

*Primary Examiner*—Allan N. Shoap
*Assistant Examiner*—Paul Schwarz
*Attorney, Agent, or Firm*—Stevens, Davis, Miller & Mosher

[57] ABSTRACT

The invention relates to a vial for storing a substance in a condition in which it is excludeded from the ambient air, comprising a reservoir having a closed end and an open end, the open end communicating with a closable tubular member via a neck portion. The vial comprises a cap having a central aperture which is sealingly but detachably connected to the neck portion of the reservoir, while the tubular member constitutes a separate component of the vial and is proportioned so that it can be connected in the aperture of the cap in a circumferentially sealing manner, a rear end portion of the tubular member extending within the neck portion of the reservoir and a front portion which comprises a sealing means extending beyond the reservoir.

2 Claims, 1 Drawing Sheet

Figure 1:
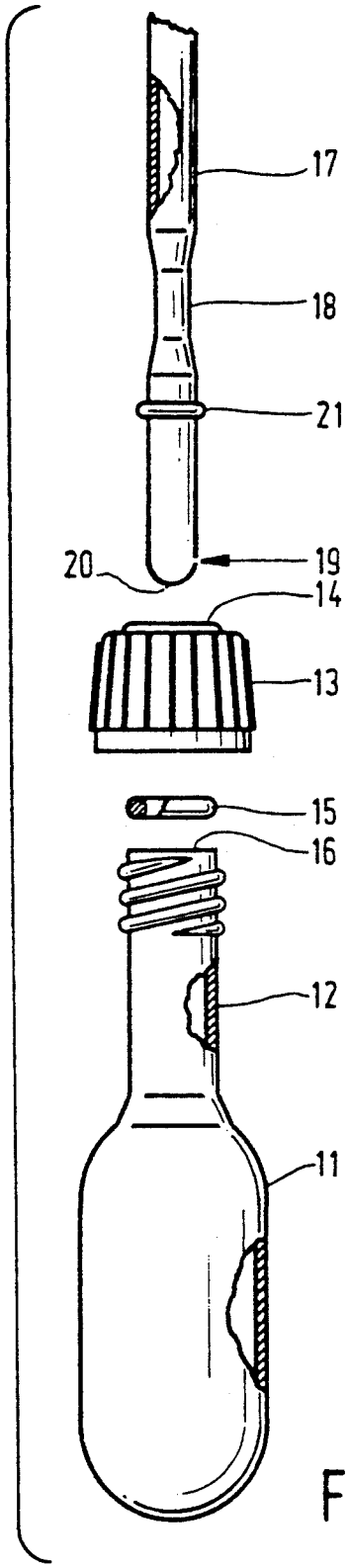

VIAL AND CAP ASSEMBLY HAVING MEANS FOR SEALING A TUBE PROJECTING BEYOND THE VIAL RESERVOIR

The invention relates to a vial for storing a substance in a condition in which it is excluded from the ambient air, comprising a reservoir having a closed end and an open end, the open end communicating via a neck portion with a closable tubular member.

Such vials, in which the neck portion continues into the tubular member which can be closed by sealing, have long been known already. The tubularly elongated neck portion usually comprises a break seal. The vial can be opened by breaking at the break seal so as to give access to the contents of the vial. Such break vials (vials having a breakable portion) are intended in particular for storing substances which can enter into an interaction with the ambient air, such as oxidation-sensitive substances, or for storing substances which form a potential danger for the environment, such as cytostatics and highly-active pharmacons, e.g. vitamin D metabolites and the like. Such substances should be stored while excluded from the ambient air, for example, in an atmosphere of an inert gas or under a vacuum.

The said known break vials have several practical objections. Prior to dispensing, the vial should be thoroughly cleaned internally and sometimes be sterilised. This is hampered by the narrow access to the reservoir.

Furthermore it is often cumbersome to dispense the reservoir of the vial with the desired substance without traces of the substance remaining in the tubular member. This impedes the sealing of the tube and in connection with the heating of the said traces this may cause various of problems. Decomposition products may contaminate the contents of the vial and vapours may be formed which are undesired, even poisonous for the environment. Furthermore, residues of the substance or decomposition products thereof, which remain in the end portion of the tubular neck portion which is discarded after sealing, may contaminate the environment or form an environmental burden. When the vial is opened by the user glass fracture may easily occur, as a result of which glass fragments may reach the substance, e.g. the pharmacon. Finally it is no longer possible to close the vial again under the desired conditions, for example under nitrogen, in an air-tight manner. This may be desirable, in particular, when only a part of the substance accommodated in the vial is necessary and the remainder has to be stored for later use.

In order to avoid the last-mentioned disadvantage, U.S. Pat. Specification 4,266,681 suggests to provide the tubularly elongated neck portion of the vial with several alternately provided "seal points" and "break points", so that after opening the vial the same may be resealed. This may be repeated, if so desired, although the number of discrete "seal points" and "break points" will in practice be restricted in connection with the length of the tubularly elongated neck portion, said length being limited in practice.

Apart from the vulnerability of such a vial, the possibility of incorrect use, namely breaking and opening at the most inwardly located break point, is very large. To avoid contamination of the contents of the vial during sealing, reference is made to a prior U.S. Pat. Specification, namely 3,688,812, in which a certain auxiliary means is used during sealing.

It is the object of the invention to provide a vial for storing a substance in a condition sealed from the ambient air, which vial does not exhibit the disadvantages mentioned hereinbefore and which permits repeated samplings succeeded by sealings.

This object can be achieved by means of a vial of the type described in the opening paragraph which according to the present invention is characterised in that the vial comprises a cap having a central aperture which is sealingly but detachably connected to the neck portion of the reservoir, and that the tubular member forms a separate component of the vial and is proportioned so that it can be connected in the aperture of the cap in a circumferentially sealing manner, a rear end portion of the tubular member extending within the neck portion of the reservoir and a front portion which comprises a sealing means projecting beyond the reservoir.

The advantages of such a vial over the known break vial are apparent from a description of the use of the vial.

Cleaning and optionally sterilising the reservoir before dispensing does not present any problem at all because the interior of the reservoir is readily accessible. In the unassembled condition the reservoir is filled with the desired substance via the wide neck portion. The cap with the tubular member secured therein is then connected to the neck portion of the reservoir. This connection is preferably a screw connection but may optionally also be any other connection, for example, a bayonet catch or a clamping connection. The air present in the reservoir may be displaced, for example, by rinsing with an inert gas or by evacuation succeeded by admission of an inert gas. The tubular member is then closed; for this purpose the sealing means is used which is present in the front portion of the tubular member projecting beyond the reservoir. It will be obvious that as a result of this construction contamination of the front portion of the tubular member with the substance cannot possibly occur, because the said tubular member is provided only after dispensing. Of course it is furthermore of great importance that the cap with the tubular member can be detached again from the reservoir, so that the reservoir becomes accesssible for taking out a quantity of the substance or the whole contents of the reservoir, whichever may be desired. If there is still any substance left in the reservoir, the vial may be closed again in the same manner as described hereinbefore. So in this manner any desired quantity of substance may be taken out of the reservoir, after which the remainder can be stored again while closed under suitable conditions.

The vial according to the invention is preferably constructed so that a sealing ring of a flexible material is clamped between the inner wall of the cap and the outer edge of the neck portion, which ring in the assembled condition of the tubular member keeps the said member hermetically enclosed. In this manner it is achieved that the tubular member is connected hermetically in the aperture of the cap so that after closing the contents of the vial can without any risk be stored for long periods of time while sealed from the ambient air. The ring is preferably manufactured from an elastic synthetic resin or a rubber suitable for the purpose, for example, a degased fluorohydrocarbon elastomer, for example, FPM rubber.

It is of further advantage for the tubular member to be detachably connectible in the aperture of the cap. This facilitates the re-closing of the vial under conditioned circumstances of the contents thereof, in particuler when an irreversible closing of the tubular member is used. In this case, as a matter of fact, a new tubular member may simply be connected upon re-closing, after which the desired conditions, for example, an atmosphere of an inert gas, may be introduced in the reservoir by evacuation or rinsing.

The sealing means in the front portion of the tubular member projecting from the reservoir may be constructed so that an irreversible closing is obtained. In a favourable embodiment the tubular member is manufactured from a readily meltable glass and the tubular member comprises a capillary narrowed portion or inward constriction as a sealing means. The tubular member can readily be sealed at the area of the said inward constriction, as a result of which a reliable sealing is obtained.

In another suitable construction, however, the tubular member can be sealed reversibly and then comprises a stop cock as a sealing means. By simply turning on or closing the cock the contents of the reservoir can simply be made to communicate with any desired medium, for example, an inert gas or a vacuum. Upon re-closing the vial, the tubular member need not be replaced and may be used again as such.

In order to avoid substance as much as possible from penetrating out of the reservoir into the tubular member during evacuating or rinsing with a gaseous medium, it is of advantage to construct the tubular member so that the rear end portion which extends within the neck portion of the reservoir is closed except for a small aperture. The said aperture is preferably present in the sidewall of the tubular member—the rear end being closed entirely—or at the area where the sidewall passes into the closed rear end.

It will be obvious that the reservoir will preferably be manufactured from glass so as to avoid any interaction with the substance and diffusion of air-oxygen. The cap is preferably manufactured from a suitable non-deformable synthetic material. The tubular member may be manufactured from glass but, when a stop cock is used as a closing means, it may also be manufactured from a suitable non-deformable synthetic resin.

Figure 2:
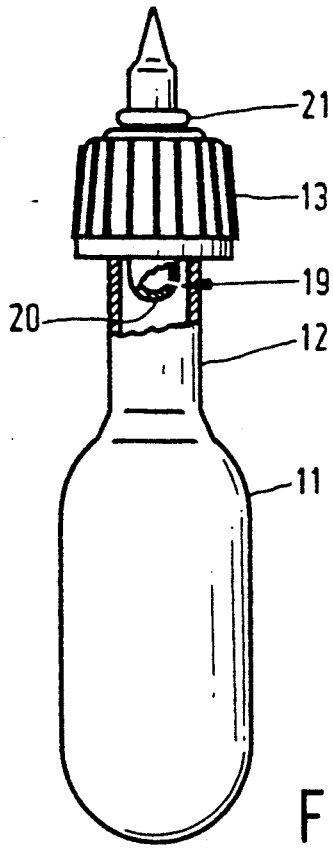

The invention will now be described in greater detail with reference to the accompanying drawing, in which FIG. 1 is an exploded view of a vial according to the invention, partly as a side elevation and partly as a longitudinal sectional view, and FIG. 2 shows a vial according to the invention, this time in the assembled condition and closed, likewise partly as a side elevation and partly as a longitudinal sectional view.

The vial shown comprises a cylindrical reservoir 11 having at its front open end a neck portion 12 which is provided with external screwthread. A screw cap 13 the screwthread of which matches the screwthread of the neck portion of the reservoir, comprises an aperture 14. An O-ring 15 of FPM rubber fits in the screw cap and after connecting the screw cap bears on the end 16 of the neck portion of the reservoir. A tubular member 17 fits in the aperture 14 of the screw cap and comprises a narrowed portion or inward constriction 18. The tubular member which comprises a circumferentially extending ridge 21 is closed at one end 20 except for a small aperture 19.

When using the vial, the substance is first introduced into the reservoir 11. The tubular member 17 is then inserted with its end 20 through the aperture 14 of the screw cap until the ridge 21 bears on the upper surface of the cap, after which the screw cap with intermediately positioned O-ring 15 is screwed to the neck portion 12 of the reservoir 11. Since the O-ring is clamped between the end 16 of the neck portion and the inner wall of the screw cap, the ring slightly expands inwardly and in this manner keeps the tubular member hermetically enclosed. The substance in the reservoir may now be brought in an inert medium, if so desired, for example, under nitrogen, by rinsing with nitrogen. The nitrogen flow may be supplied and removed via the tubular member 17. After sealing the tubular member at 18, the situation shown in FIG. 2 is obtained.

For taking a quantity of substance out of the vial, the vial may simply be opened by unscrewing the cap with the sealed tubular member from the reservoir. For closing again, the tubular member should be replaced by a new one, after which the above procedure may be repeated.

In a likewise suitable embodiment the tubular member is constructed with a stop cock as a sealing means instead of inward constriction 18. The tubular member may now be closed by turning the cock. For reclosing, the same tubular member may be used again.

It is desirable for the filled vials to be supplied "tamper-proof", for example, in a collection pack. Shrink wrapping is particularly suitable for such a pack.

I claim:

1. A vial for storing a substance in a condition in which it is excludes from ambient air, comprising a reservoir, a closable tubular member and a cap having a central aperture, said reservoir having a closed end and an open end, the open end communicating via a neck portion with the closable tubular member, wherein the cap is sealingly but detachably connected to the neck portion of the reservoir, and the tubular member constitutes a separate component of the vial and is proportioned so that it can be connected in the aperture of the cap in a circumferentially sealing manner, the tubular member having a rear end portion and a front end portion, the rear end portion thereof extending within the neck portion of the reservoir and the front portion comprising a sealing means for temporarily sealing the tubular member projecting beyond the reservoir;

a sealing ring of a flexible material being clamped between an inner wall of the cap and an outer edge of the neck portion, said ring in the assembled condition of the tubular member keeping said member hermetically enclosed;

wherein the tubular member can be detachably connected in the aperture of the cap and is manufactured from a readily meltable glass; and the front portion of the tubular member comprises a capillary inward construction as a sealing means.

2. A vial as claimed in claim 1, wherein the rear end portion of the tubular member is closed except for a small aperture.

* * * * *